United States Patent [19]

Otsuka et al.

[11] 4,375,800

[45] Mar. 8, 1983

[54] CONTROL SYSTEM FOR INTERNAL COMBUSTION ENGINES, PROVIDED WITH AN EXHAUST GAS RECIRCULATION CONTROL HAVING A FAIL SAFE FUNCTION

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 298,004

[22] Filed: Aug. 31, 1981

[30] Foreign Application Priority Data

Sep. 2, 1980 [JP] Japan ..... 55-122098

[51] Int. Cl.[3] ..... F02M 25/06

[52] U.S. Cl. ..... 123/571; 123/569

[58] Field of Search ..... 123/571, 568

[56] References Cited

FOREIGN PATENT DOCUMENTS 2815109 11/1978 Fed. Rep. of Germany ..... 123/571

*Primary Examiner*—Wendell E. Burns

*Attorney, Agent, or Firm*—Lyon & Lyon

[57] ABSTRACT

A control system for internal combustion engines, which comprises: a power transistor connected to the solenoid of a solenoid valve forming an EGR control valve for energization of the same; an abnormality detecting circuit arranged for comparing the input and output levels of the power transistor to generate an output signal when the two levels are out of an inverted relationship; a timer arranged for generating an output signal when the output signal of the abnormality detecting circuit is continuously generated over a predetermined period of time; and emergency means actuatable by the output signal of the timer. The emergency means may include an alarm device and a safety circuit, both responsive to the output of the timer to give the alarm and render the power transistor inoperative, respectively.

7 Claims, 3 Drawing Figures

CONTROL SYSTEM FOR INTERNAL COMBUSTION ENGINES, PROVIDED WITH AN EXHAUST GAS RECIRCULATION CONTROL HAVING A FAIL SAFE FUNCTION

BACKGROUND OF THE INVENTION

This invention relates to a control system for internal combustion engines, which is provided with an exhaust gas recirculation system, and more particularly to a control system for internal combustion engines, which has a fail safe function of detecting a failure in the control section of the exhaust recirculation system and perform necessary actions for safety.

An exhaust gas recirculation system (EGR system) is already known which includes an exhaust gas recirculation passageway communicating the exhaust system of an internal combustion engine with the intake system of the same for introducing inert exhaust gases in the exhaust system into the suction mixture in the intake system therethrough to lower a maximum combustion temperature in engine cylinders and accordingly decrease the amount of NOx to be present in the exhaust gases.

On the other hand, an internal combustion engine is conventionally provided with various control systems for controlling the engine in order to operate in optimum states. For instance, air/fuel ratio control systems have been proposed e.g. by the assignee of the present application, which perform feedback control of the air/fuel ratio of an air/fuel mixture being supplied to the engine, in response to the concentration of an exhaust gas ingredient emitted from the engine. Such control systems are connected with various sensors for detecting various operating conditions of the engine to control the air/fuel ratio and other engine operating factors in response to output signals of these sensors so as for the engine to operate in optimum states.

Exhaust gas recirculating operation by means of the aforementioned exhaust gas recirculation system needs to be interrupted when the engine is under particular operating conditions such as engine idle, engine deceleration and low engine temperature operation for prevention of incomplete combustion within engine cylinders. To this end, an exhaust gas recirculation system in general is connected to a control system which is one of the aforementioned control systems and is controlled by a control signal supplied from an electronic control circuit or the like provided in the control system to interrupt its exhaust gas recirculating operation during the above-mentioned particular engine operating conditions.

The conventional exhaust recirculation systems include a type which comprises an exhaust gas recirculation control valve having negative pressure-actuatable means and arranged across the exhaust gas recirculation passageway, a negative pressure passageway communicating the negative pressure-actuatable means with the exhaust gas recirculation control valve, and an EGR control valve formed of a solenoid valve arranged for opening and closing the negative pressure passageway.

The solenoid valve which forms the EGR control valve is arranged to have its solenoid energized for operation by means of a power transistor provided within the above-mentioned electronic control circuit or the like. There can occur a break or a short in the solenoid winding or in the wiring related to the solenoid winding and the power transistor, or a failure in the power transistor per se. In such an event, control of the exhaust gas recirculation cannot be properly effected, which can cause incomplete combustion in engine cylinders, thus making it impossible to control the engine to operate in optimum states. Particularly in an air/fuel ratio control system, if a control device, which is used to control the exhaust recirculation control valve, becomes defective, the air/fuel ratio can be controlled to an improper value, which can spoil the driveability and exhaust emission characteristics of the engine.

OBJECTS AND SUMMARY OF THE INVENTION

It is an object of the invention to provide a control system for internal combustion engines, which is provided with an exhaust gas recirculation system in which the solenoid of a solenoid valve forming the EGR control valve is driven by means of a power transistor, the control system having a function of positively detecting a failure in the control section of the exhaust gas recirculation system by detecting abnormality in the logical relationship between the input and output levels of the power transistor.

It is a further object of the invention to provide a control system for internal combustion engines, which has a function of rendering the power transistor inoperative, and if necessary, effecting an alarming action when abnormality is detected in the control section of the exhaust gas recirculation system to thereby enable taking emergency measures for coping with a failure in the above control section in a prompt manner.

The present invention is based upon a discovery of the fact that during normal operation the input level and output level of a power transistor for driving the solenoid of a solenoid valve forming the EGR control valve is always in a relationship inverted with respect to each other, and provides a control system for controlling an internal combustion engine having an intake system and an exhaust system, which comprises: an exhaust gas recirculation passageway communicating the intake system of the engine with the exhaust system of the same; an exhaust gas recirculation control valve having negative pressure-actuatable means and arranged across the exhaust gas recirculation passageway; a negative pressure passageway communicating the negative pressure-actuatable means with the intake system; a solenoid valve arranged for opening and closing the negative pressure passageway; a power transistor connected to the solenoid of the solenoid valve for energization of the same; and an abnormality detecting circuit arranged to compare the input level of the power transistor with the output level of the same and produce a first signal when the two levels are out of a predetermined relationship; a timer arranged to generate a second signal when the first signal is continuously generated by the abnormality detecting circuit for a predetermined period of time; and emergency means actuatable by the second signal generated by the timer. The above emergency means includes means responsive to the second signal to give the alarm and means also responsive to the second signal to render the power transistor inoperative.

The above and other objects, features and advantages of the invention will be more apparent from the ensuing detailed description taken in connection with the accompanying drawings in which:

DETAILED DESCRIPTION

Details of the invention will now be described with reference to the drawings which illustrate an embodiment of the invention.

Figure 1:
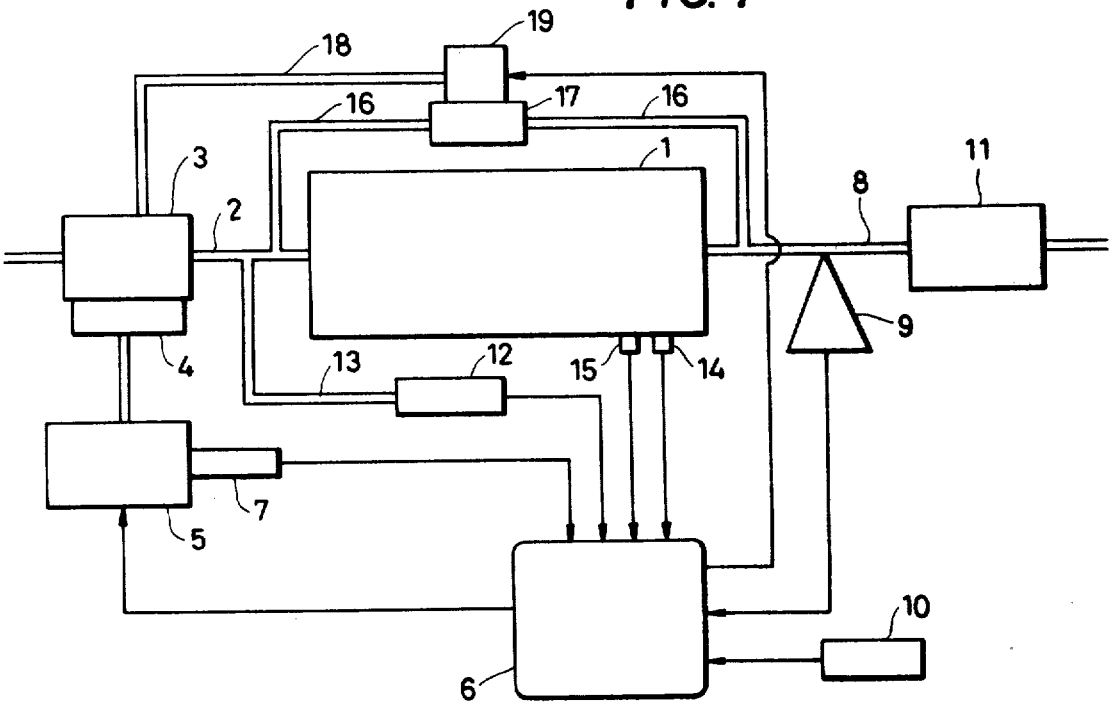
FIG. 1 is a block diagram illustrating the whole arrangement of an air/fuel ratio control system given as one embodiment of the engine control system according to the invention.

Referring first to FIG. 1, there is shown a block diagram illustrating the whole arrangement of an air/fuel ratio control system which is provided with an exhaust gas recirculation system, according to one embodiment of the invention.

Reference numeral 1 designates an internal combustion engine. Connected to the engine 1 is an intake manifold 2 which is provided with a carburetor generally designated by the numeral 3. The carburetor 3 has main and slow speed fuel passages, not shown, which communicate the float chamber, not shown, of the carburetor 3 with primary and secondary bores, not shown. These fuel passages communicate with the atmosphere by means of air bleed passages, not shown.

At least one of these fuel passages or air bleed passages is connected to an air/fuel ratio control valve 4. The air/fuel ratio control valve 4 is comprised of a required number of flow rate control valves, not shown, each of which is driven by a pulse motor 5 so as to vary the opening of the at least one of the above passages. The pulse motor 5 is electrically connected to an electronic control unit (hereinafter called "ECU") 6 to be rotated by driving pulses supplied therefrom so that the flow rate control valves are displaced to vary the flow rate of air or fuel being supplied to the engine 1 through the at least one passage. Although the air/fuel ratio can be controlled by thus varying the flow rate of air or fuel being supplied to the engine 1, a preferable concrete measure should be such as varies the opening of at least one of the aforementioned air bleed passages to control the flow rate of bleed air.

The pulse motor 5 is provided with a reed switch 7 which is arranged to turn on or off depending upon the moving direction of the valve body of the air/fuel ratio control valve 4 each time the same valve body passes a reference position, to supply a corresponding binary signal to ECU 6.

On the other hand, an $O_2$ sensor 9, which is formed of stabilized zirconium oxide or the like, is mounted in the peripheral wall of an exhaust manifold 8 leading from the engine 1 in a manner projected into the manifold 8. The sensor 9 is electrically connected to ECU 6 to supply its output signal thereto. An atmospheric pressure sensor 10 is arranged to detect the ambient atmospheric pressure surrounding the vehicle, not shown, in which the engine 1 is installed, the sensor 10 being electrically connected to ECU 6 to supply its output signal thereto, too.

Incidentally, in FIG. 1, reference numeral 11 designates a three-way catalyst, 12 a pressure sensor arranged to detect absolute pressure in the intake manifold through a conduit 13 and electrically connected to ECU 6 to supply its output signal thereto, and 14 a thermistor arranged to detect the temperature of engine cooling water and also electrically connected to ECU 6 to supply its output signal thereto. Reference numeral 15 generally designates an engine rpm sensor which is comprised of a distributor and an ignition coil and arranged to supply pulses generated in the ignition coil to ECU 6.

On the other hand, an exhaust gas recirculation passageway 16 communicates the exhaust manifold 8 of the engine 1 with the intake manifold 2 of the same. Arranged across this passageway 16 is an exhaust gas recirculation control valve (hereinafter called "exhaust gas recirculation valve") 17. This exhaust gas recirculation valve 17 is a negative pressure-responsive type which is adapted to be opened and closed in unison with displacement of a diaphragm, not shown, forming negative pressure-actuatable means. The diaphragm communicates, by way of a negative pressure passageway 18, with a negative pressure intake port, not shown, which is arranged to open in the intake manifold 2 at a zone slightly upstream of a throttle valve, not shown, of the carburetor 3, when the throttle valve is in its fully closed position. The diaphragm is displaceable in response to negative pressure produced in the above negative pressure intaken port to open and close the exhaust gas recirculation valve 17.

An EGR control valve 19 is arranged across the negative pressure passageway 18 to open and close the same. This valve 19 is comprised of a solenoid valve and adapted to interrupt supply of negative pressure to the diaphragm of the valve 17 and simultaneously allow introduction of atmospheric air into the same diaphragm to close it, at low engine load operation such as engine idle and engine deceleration or at low engine temperature operation. The valve 19 is provided with a solenoid, not shown, arranged for energization by means of a control signal suppled from ECU 6. Detection of low engine load state is effected by means of the pressure sensor 12 which is also used for the air/fuel ratio control, hereinafter described, and which detects the absolute pressure in the intake manifold 2 through the conduit 13 opening in the intake manifold 2. The sensor 12 supplies its output signal $P_B$ indicative of detected absolute pressure to ECU 6. ECU 6 in turn is arranged to compare this output signal $P_B$ with a predetermined value $P_{BE}$ stored therein and keep the solenoid valve 19 in its closed position where transmission of negative pressure to the diaphragm of the exhaust gas recirculation valve 17 is interrupted, when the detected valve $P_B$ is lower than the predetermined valve $P_{BE}$, that is, the relationship $P_B < P_{BE}$ stands, and change the valve 17 into an opened position where negative pressure can be transmitted to the diaphragm, when the former value $P_B$ exceeds the latter value $P_{BE}$.

The temperature of the engine is detected by the aforementioned thermistor 14 in the form of the temperature of engine cooling water. ECU 6 is arranged to keep the solenoid valve 19 in its closed position so long as the detected value signal $T_W$ produced by the thermistor 14 does not exceed a predetermined value $T_{WE}$, that is, the relationship $T_W < T_{WE}$ stands.

Details of the air/fuel ratio control which can be performed by the air/fuel ratio control system according to the invention outlined above will now be described by further reference to FIG. 1 which has been referred to hereinabove.

Initialization

Referring first to the initialization, when the ignition switch in FIG. 1 is set on, ECU 6 is initialized to detect the reference position of the actuator or pulse motor 5 by means of the reed switch 7 and hence drive the pulse motor 5 to set it to its best position (a preset position) for starting the engine, that is, set the initial air/fuel ratio to a predetermined proper value. The above preset position of the pulse motor 5 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idle rpm.

The above reference position of the pulse motor 5 is detected as the position at which the reed switch 7 turns on or off, as previously mentioned with reference to FIG. 1.

Then, ECU 6 monitors the condition of activation of the $O_2$ sensor 9 and the coolant temperature Tw detected by the thermistor 14 to determine whether or not the engine is in a condition for initiation of the air/fuel ratio control. For accurate air/fuel ratio feedback control, it is a requisite that the $O_2$ sensor 9 is fully activated and the engine is in a warmed-up condition. The $O_2$ sensor, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 6, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions have been fulfilled that the sensor produces an activation signal when its output voltage lowers down to a predetermined voltage Vx (e.g., 0.5 volt), a timer finishes counting for a predetermined period of time $t_x$ (e.g., 1 minute) starting from the occurrence of the above activation signal, and the coolant temperature Tw increases up to a predetermined value Twx at which an automatic choke, not shown, is opened to an opening for enabling the air/fuel ratio feedback control.

During the above stage of the detection of activation of the $O_2$ sensor and the coolant temperature Tw, the pulse motor 5 is held at its predetermined position $PS_{CR}$. The pulse motor 5 is driven to appropriate positions in response to the operating condition of the engine after initiation of the air/fuel ratio control, as hereinlater described.

Basic Air/Fuel Ratio Control

Following the initialization, the program in ECU 6 proceeds to the basic air/fuel ratio control.

ECU 6 is responsive to various detected value signals representing the output voltage V of the $O_2$ sensor 9, the absolute pressure $P_B$ in the intake manifold 2 detected by the pressure sensor 12, the engine rpm Ne detected by the rpm sensor 15, and the atmospheric pressure $P_A$ detected by the atmospheric pressure sensor 10, to drive the pulse motor 5 as a function of the values of these signals to control the air/fuel ratio. More specifically, the basic air/fuel ratio control comprises open loop control which is carried out at wide-open-throttle, at engine idle, at engine deceleration, and at engine acceleration at the standing start of the engine, and closed loop control which is carried out at engine partial load. All the control is initiated after completion of the warming-up of the engine.

First, the condition of open loop control at wide-open-throttle is met when the differential pressure $P_A - P_B$ (gauge pressure) between the absolute pressure $P_B$ detected by the pressure sensor 12 and the atmospheric pressure $P_A$ (absolute pressure) detected by the atmospheric pressure sensor 10 is lower than a predetermined value $\Delta P_{WOT}$. ECU 6 compares the difference in value between the output signals of the sensors 10, 12 with the predetermined value $\Delta P_{WOT}$ stored therein, and when the relationship of $P_A - P_B < \Delta P_{WOT}$ stands, drives the pulse motor 5 to a predetermined position (preset position) $PS_{WOT}$ and holds it there.

The condition of open loop control at engine idle is met when the engine rpm Ne is lower than a predetermined idle rpm $N_{IDL}$ (e.g., 1,000 rpm). ECU 6 compares the output signal valve Ne of the rpm sensor 15 with the predetermined rpm $N_{IDL}$ stored therein, and when the relationship of Ne $N_{IDL}$ stands, drives the pulse motor 5 to a predetermined idle position (preset position) $PS_{IDL}$ and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 6 compares the output signal value $P_B$ of the pressure sensor 12 within the predetermined value $PB_{DEC}$ stored therein, and when the relationship of $P_B < PB_{DEC}$ stands, drives the pulse motor 5 to a predetermined deceleration position (preset position) $PS_{DEC}$ and holds it there.

The air/fuel ratio control at engine acceleration (i.e., standing start or off-idle acceleration) is carried out when the engine rpm Ne exceeds the aforementioned predetermined idle rpm $N_{IDL}$ (e.g., 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 6 rapidly moves the pulse motor 5 to a predetermined acceleration position (preset position) $PS_{ACC}$, which is immediately followed by initiation of the air/fuel ratio feedback control, described hereinlater.

During operations of the above-mentioned open loop control at wide-open-throttle, at engine idle, at engine deceleration, and at engine off-idle acceleration, the respective predetermined positions $PS_{WOT}$, $PS_{IDL}$, $PS_{DEC}$ and $PS_{ACC}$ for the pulse motor 5 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 6 performs selectively feedback control based upon proportional term correction (hereinafter called "P term control") and feedback control based upon integral term correction (hereinafter called "I term control"), in response to the engine rpm Ne detected by the engine rpm sensor 15 and the output signal V of the $O_2$ sensor 9. To be concrete, when the output voltage V of the $O_2$ sensor 9 varies only at the higher level side or only at the lower level side with respect to a reference voltage Vref, the position of the pulse motor 5 is corrected by an integral value obtained by integrating the value of a binary signal which changes in dependence on whether the output voltage of the $O_2$ sensor is at the higher level or at the lower level with respect to the predetermined reference voltage Vref (I term control). On the other hand, when the output signal V of the $O_2$ sensor changes from the higher level to the lower level or vice versa, the position of the pulse motor 5 is corrected by a value directly proportional to a change in the output voltage V of the $O_2$ sensor (P term control).

According to the above I term control, the number of steps by which the pulse motor is to be displaced per second is increased with an increase in the engine rpm so that it is larger in a higher engine rpm range.

Whilst, according to the P term control, the number of steps by which the pulse motor is to be displaced per second is set at a single predetermined value (e.g., 6 steps), irrespective of the engine rpm.

In transition from the above-mentioned various open loop control to the closed loop control at engine partial load or vice versa, changeover between open loop mode and closed loop mode is effected in the following manner: First, in changing from closed loop mode to open loop mode, ECU 6 moves the pulse motor 5 to a predetermined position $PS_{CR}$, $PS_{WOT}$, $PS_{IDL}$, $PS_{DEC}$ or $PS_{ACC}$, irrespective of the position at which the pulse motor was located immediately before entering each open loop control. This predetermined position is corrected in response to actual atmospheric pressure as hereinlater referred to.

On the other hand, in changing from open loop mode to closed loop mode, ECU 6 commands the pulse motor 5 to initiate air/fuel ratio feedback control with I term correction.

To obtain optimum exhaust emission characteristics irrespective of changes in the actual atmospheric pressure during open loop air/fuel ratio control or at the time of shifting from open loop mode to closed loop mode, the position of the pulse motor 5 needs to be compensated for atmospheric pressure. According to the invention, the above-mentioned predetermined or preset positions $PS_{CR}$, $PS_{WOT}$, $PS_{IDL}$, $PS_{DEC}$ and $PS_{ACC}$ at which the pulse motor 5 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of the $C_{CR}$, $C_{WOT}$, $C_{IDL}$, $C_{DEC}$ and $C_{ACC}$. The values of PSi and Ci are previously stored in ECU 6.

ECU 6 applies to the above equation the coefficients PSi, Ci which are determined at proper different values according to the kinds of open loop control to be carried out, to calculate by the above equation the position $PSi(P_A)$ for the pulse motor 5 to be set at a required kind of open loop control and moves the pulse motor 5 to the calculated position $PSi(P_A)$.

Figure 2:
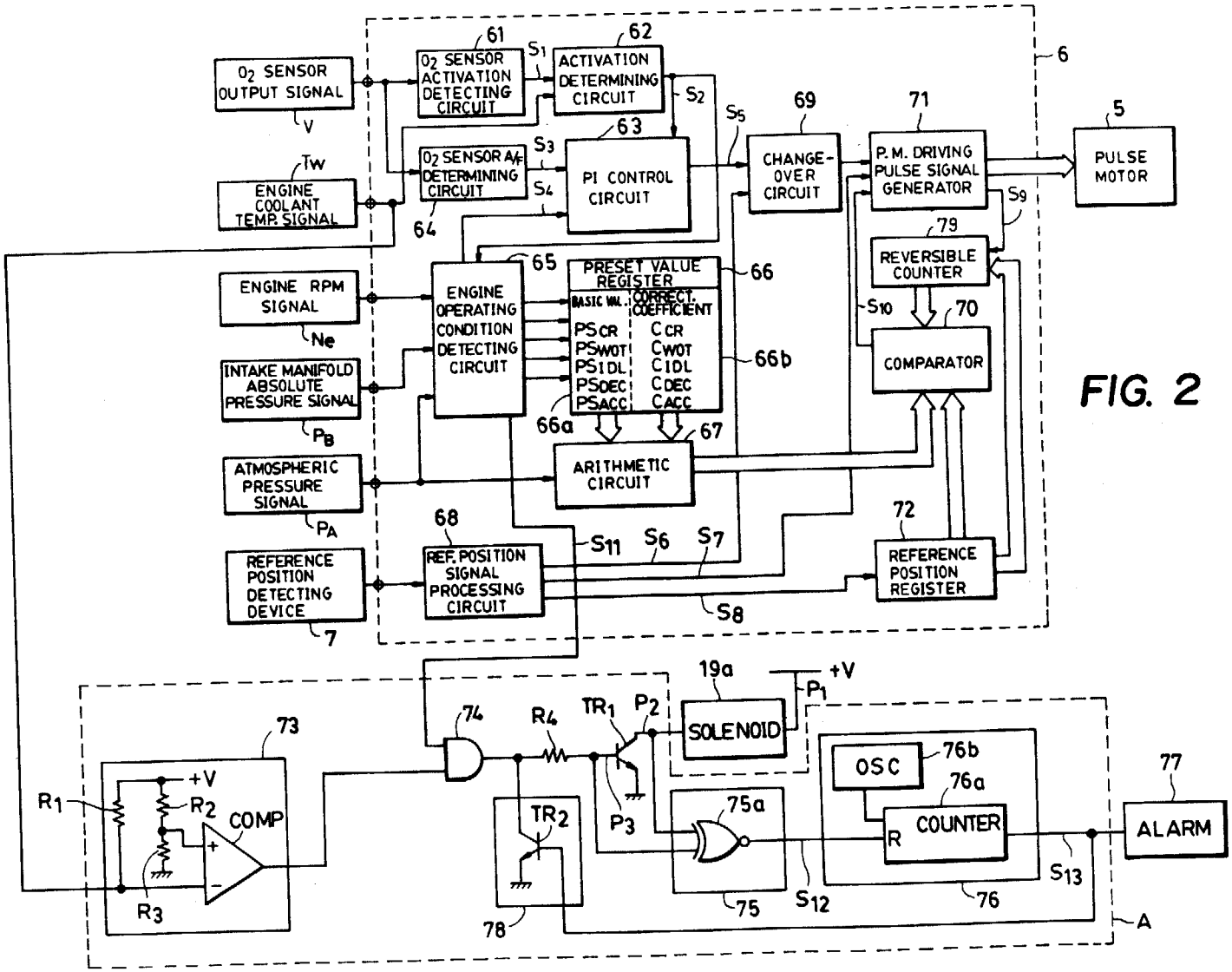
FIG. 2 is a block diagram illustrating an electrical circuit provided with an exhaust gas recirculation control device, which is provided within the electronic control unit (ECU) appearing in FIG. 1.

FIG. 2 is a block diagram illustrating the interior construction of ECU 6 used in the air/fuel ratio control system having the above-mentioned functions according to the invention. In ECU 6, reference numeral 61 designates a circuit for detecting the activation of the $O_2$ sensor 9 in FIG. 1, which is supplied at its input with an output signal V from the $O_2$ sensor. Upon passage of the predetermined period of time Tx after the voltage of the above output signal V has dropped below the predetermined value Vx, the above circuit 61 supplies an activation signal $S_1$ to an activation determining circuit 62. This activation determining circuit 62 is also supplied at its input with an engine coolant temperature signal Tw from the thermistor 14 in FIG. 1. When supplied with both the above activation signal $S_1$ and the coolant temperature signal Tw indicative of a value exceeding the predetermined value Twx, the activation determining circuit 62 supplies an air/fuel ratio control initiation signal $S_2$ to a PI control circuit 63 to render the same ready to operate. Reference numeral 64 represents an air/fuel ratio determining circuit which determines the value of air/fuel ratio of engine exhaust gases, depending upon whether or not the output voltage of the $O_2$ sensor 9 is larger than the predetermined value Vref, to supply a binary signal $S_3$ indicative of the value of air/fuel ratio thus obtained, to the PI control circuit 63. On the other hand, an engine operating condition detecting circuit 65 is provided in ECU 6, which is supplied with an engine rpm signal Ne from the engine rpm sensor 15, an absolute pressure signal $P_B$ from the pressure sensor 12, an atmospheric pressure $P_A$ from the atmospheric pressure sensor 10, all the sensors being shown in FIG. 1, and the above control initiation signal $S_2$ from the activation determining circuit 62 in FIG. 2, respectively. The circuit 65 supplies a control signal $S_4$ indicative of a value corresponding to the values of the above input signals to the PI control circuit 63. The PI control circuit 63 accordingly supplies a change-over circuit 69 to be referred to later with a pulse motor control signal $S_5$ having a value corresponding to the air/fuel ratio signal $S_3$ from the air/fuel ratio determining circuit 64 and a signal component corresponding to the engine rpm Ne in the control signal $S_4$ supplied from the engine operating condition detecting circuit 65. The engine operating condition detecting circuit 65 also supplies the PI control circuit 63 with the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine operating condition detecting circuit 65, the PI control circuit 63 interrupts its own operation. Upon interruption of the supply of the above signal component to the control circuit 63, a pulse signal $S_5$ is outputted from the circuit 63 to the change-over circuit 69, which signal starts air/fuel ratio control with integral term correction.

A preset value register 66 is provided in ECU 6, which is formed of a basic value register section **66*a* in which are stored the basic values of preset values $PS_{CR}$, $PS_{WOT}$, $PS_{IDL}$, $PS_{DEC}$ and $PS_{ACC}$ for the pulse motor position, applicable to various engine conditions, and a correcting coefficient register section 66*b* in which are stored atmospheric pressure correcting coefficients $C_{CR}$, $C_{WOT}$, $C_{IDL}$, $C_{DEC}$ and $C_{ACC}$ for these basic values. The engine operating condition detecting circuit 65 detects the operating condition of the engine based upon the activation of the $O_2$ sensor and the values of engine rpm Ne, intake manifold absolute pressure $P_B$ and atmospheric pressure $P_A$ to read from the register 66 the basic value of a preset value corresponding to the detected operating condition of the engine and its corresponding correcting coefficient and apply the same to an arithmetic circuit 67. The arithmetic circuit 67 performs arithmetic operation responsive to the value of the atmospheric pressure signal $P_A$, using the equation $PSi(P_A)=PSi+(760-P_A)\times Ci$. The resulting preset value is applied to a comparator 70**.

On the other hand, a reference position signal processing circuit 68 is provided in ECU 6, which is responsive to the output signal of the reference position detecting device (reed switch) 7, indicative of the switching of the same, to generate a binary signal $S_6$ having a certain level from the start of the engine until it is detected that the pulse motor reaches the reference position. This binary signal $S_6$ is supplied to the change-over circuit 69 which in turn keeps the control signal $S_5$ from being transmitted from the PI control circuit 63 to a pulse motor driving signal generator 71 as long as it is supplied with this binary signal $S_6$, thus avoiding the interference of the operation of setting the pulse motor to the initial position with the operation of P-term/I-term control. The reference position signal processing circuit 68 also generates a pulse signal $S_7$ in response to the output signal of the reference position detecting device 7, which signal causes the pulse motor 5 to be driven in the step-increasing direction or in the step-decreasing direction so as to detect the reference position of the pulse motor 5. This signal $S_7$ is supplied directly to the pulse motor driving signal generator 71 to cause same to drive the pulse motor 5 until the reference position is detected. The reference position signal processing circuit 68 generates another pulse signal $S_8$ each time the reference position is detected. This pulse signal $S_8$ is supplied to a reference position register 72 in which the value of the reference position (e.g., 50 steps) is stored. This register 72 is responsive to the above signal $S_8$ to apply its stored value to one input terminal of the comparator 70 and to the input of a reversible counter 79. The reversible counter 79 is also supplied with an output pulse signal $S_9$ generated by the pulse motor driving signal generator 71 to count the pulses of the signal $S_9$ corresponding to the actual position of the pulse motor 5. When supplied with the stored value from the reference position register 72, the counter 79 has its counted value replaced by the value of the reference position of the pulse motor.

The counted value thus renewed is applied to the other input terminal of the comparator 70. Since the comparator 70 has its other input terminal supplied with the same pulse motor reference position value, as noted above, no output signal is supplied from the comparator 70 to the pulse motor driving signal generator 71 to thereby hold the pulse motor at the reference position with certainty. Subsequently, when the $O_2$ sensor 9 remains deactivated, an atmospheric pressure-compensated preset value $PS_{CR}(P_A)$ is outputted from the arithmetic circuit 67 to the one input terminal of the comparator 70 which in turn supplies an output signal $S_{10}$ corresponding to the difference between the preset value $PS_{CR}(P_A)$ and a counted value supplied from the reversible counter 79, to the pulse motor driving signal generator 71, to thereby achieve accurate control of the position of the pulse motor 5. Also, when the other open loop control conditions are detected by the engine operating condition detecting circuit 65, similar operations to that just mentioned above are carried out.

In FIG. 2, block A generally designates an exhaust gas recirculation control device provided within ECU 6. Reference numeral 73 designates a temperature determining circuit which includes a comparator COMP. The comparator COMP is arranged to be supplied at its inverting input terminal with an engine coolant temperature signal $T_W$ from the junction of one end of the thermistor 14 in FIG. 1 which has its other end grounded, with one end of a resistance $R_1$ which has its other end connected to a positive voltage power source, not shown. The comparator COMP has its non-inverting input terminal connected to the junction of a resistance $R_2$ with a resistance $R_3$, the resistances $R_2$, $R_3$ being serially connected between the positive voltage power source and the ground for providing a reference voltage at their junction. The voltage at the junction of the resistance $R_2$ with the resistance $R_3$ is set at a value corresponding to the aforementioned value $T_{WE}$ of engine coolant temperature for determining interruption of the exhaust gas recirculation. The comparator COMP has its output terminal connected to one input terminal of an AND circuit 74 which is arranged to be supplied at its other input terminal with a signal $S_{11}$ from the engine operating condition detecting circuit 65. The AND circuit 74 has its output terminal connected to the base of an NPN transistor $TR_1$ which is used as a power transistor for driving the EGR control valve 19 in FIG. 1, by way of a current limiting resistance $R_4$. This transistor $TR_1$ has its emitter grounded and its collector connected to one end of the solenoid 19a of the EGR control valve 19 in FIG. 1. The other end of the solenoid 19a is connected to the positive voltage power source. Connected to the transistor $TR_1$ is a logical abnormality detecting circuit 75 which is comprised of an exclusive NOR circuit 75a. More specifically, the transistor $TR_1$ has its base connected to one input terminal of the exclusive NOR circuit 75a and its collector to another input terminal of the same circuit, respectively. The logical abnormality detecting circuit 75 has its output connected to the reset signal input terminal R of a counter 76a which forms part of a timer circuit 76, and is adapted to apply its output binary signal $S_{12}$ to the terminal R of the same. The counter 76a has a counting pulse input terminal connected to the output of an oscillator 76b which is adapted to generate pulses with a constant period. The counter 76a is adapted to be resetted to zero when supplied at its reset signal input terminal R with a binary output $S_{12}$ of 0 from the circuit 75, and count pulses outputted from the oscillator 76b as long as it is supplied at its reset signal input terminal R with a binary output $S_{12}$ of 1 from the circuit 75. The counter 76a is also adapted to continuously generate a binary signal $S_{13}$ of 1, upon counting up a predetermined number of pulses corresponding to a predetermined period of time ta, described hereinlater, and supplied from the oscillator 76b.

Connected to the output of the counter 76a of the timer circuit 76 is an alarm device 77 which is adapted to be triggered by a binary output of 1 supplied from the counter 76a to give warnings.

Further connected to the output of the counter 76a is the base of an NPN transistor $TR_2$ which forms part of a safety circuit 78. The transistor $TR_2$ has its collector connected to the output of an OR circuit 74 and is emitter grounded.

The operation of the above exhaust gas recirculation control device according to the invention will now be described. At low engine temperature operation when the output $T_W$ of the thermistor 14 is higher than the reference voltage set by the resistances $R_2$, $R_3$ of the temperature determining circuit 73, the comparator COMP generates a low binary output of 0. The engine operating condition detecting circuit 65 is adapted to generate a binary signal $S_{11}$ of 0 when the absolute pressure signal $P_B$ supplied from the pressure sensor 12 is lower than the predetermined value $P_{BE}$ for determination of the interruption of the exhaust gas recirculation. Therefore, either one of the conditions of interruption of the exhaust gas recirculation of $T_W<T_{WE}$ and $P_B<P_{BE}$ is fulfilled, the AND circuit 74 is supplied at its one input terminal with an output of 0 from either one of the temperature determining circuit 73 and the engine operating condition detecting circuit 65, so that the circuit 74 generates a binary output of 0 and accordingly the transistor $TR_1$ has a low base potential (=0) and is therefore in an off state. As a consequence, the solenoid 19a of the EGR control valve 19 has identical or high potentials $P_1$, $P_2$ at its opposite ends and is therefore in a deenergized state to keep the exhaust gas recirculation valve 18 inoperative to keep the exhaust gas recirculation from being carried out.

On the other hand, when the engine is in an operating state where neither of the aforementioned conditions of $T_W<T_{WE}$ and $P_B<P_{BE}$ is fulfilled, that is, an operating state other than a low load and low temperature state, the temperature determining circuit 73 and the engine operating condition detecting circuit 65 both apply binary signals of 1 to the AND circuit 74 to cause the same to generate a binary output of 1. Thus, the transistor $TR_1$ has its base potential $P_3$ elevated to turn on and accordingly its collector potential $P_2$ lowered to energize the solenoid 19a so that the exhaust gas recirculation is carried out.

In the above-mentioned manner, control of the exhaust gas recirculation is effected in response to the engine coolant temperature $T_W$ and the intake manifold-absolute pressure $P_B$. As will be noted from the above explanation as well, during normal operation when no abnormality exists in the power transistor $TR_1$, the solenoid 19a of the EGR control valve 19, the wiring connecting therebetween, the wiring of the power feeding system for the solenoid 19a, etc., the input level and output level of the power transistor $TR_1$, that is, the base potential $P_3$ and the collector potential $P_2$ are placed in a relationship inverted in level with respect to each other. For instance, when one of them is at a high level, the other is at a low level.

Therefore, during normal operation, the exclusive NOR circuit 75a of the logical abnormality detecting circuit 75 has its two input terminals supplied with different levels of inputs corresponding to the potentials $P_2$, $P_3$ so that the circuit 75a continuously supplies a signal $S_{12}$ of 0 to the reset signal input terminal R of the counter 76a of the timer circuit 76. Since the counter 76a is adapted to be resetted by the low level signal $S_{12}$ of 0 applied to its reset signal input terminal R as previously mentioned, it has its count held at zero even when supplied at its counting pulse input terminal with pulses from the oscillator 76b, the output signal $S_{13}$ of which is therefore held at a level of 0.

Figure 3:
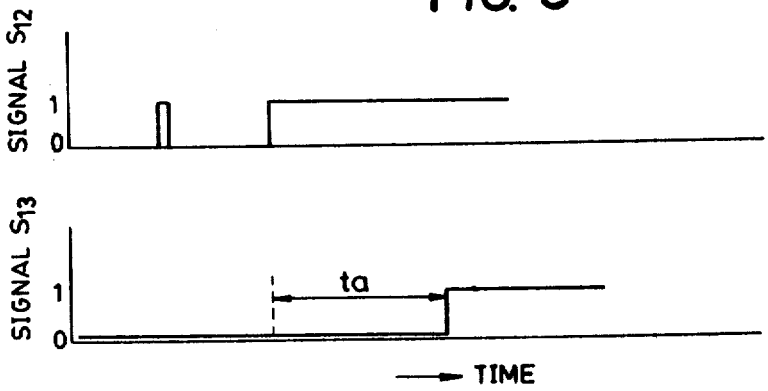
FIG. 3 is a graph showing the operation of the exhaust gas recirculation control device in FIG. 2.

With the above arrangement, when an abnormality occurs in any of the power transistor $TR_1$, the solenoid 19a, the wiring connecting therebetween, the wiring of the power feeding system for the solenoid 19a, etc., the exclusive NOR circuit 75a has its two input terminals supplied with equal levels of inputs corresponding to the potentials $P_2$, $P_3$ and accordingly applies a signal $S_{12}$ of 1 to the reset signal input terminal R of the counter 76a. The counter 76a is released from its resetted state by this signal $S_{12}$ of 1 to start counting pulses supplied from the oscillator 76b. Upon counting up a predetermined number of pulses corresponding to the predetermined period of time ta (e.g., 2 seconds), the counter 76a generates an output $S_{13}$ of 1 (FIG. 3), which is applied to the alarm device 77 to actuate the same and also applied to the base of the transistor $TR_2$ of the safety device 78 to turn the same on so that the output of the AND circuit is shorted to the ground to render the power transistor $TR_1$ inoperative.

When the duration of generation of the output signal $S_{12}$ of 1 from the logical abnormality detecting circuit 75 is shorter than the predetermined period of time ta, the counter 76a does not produce an output $S_{13}$ of 1 (FIG. 3), allowing the power transistor $TR_1$ to continue its normal operation. That is, in order to avoid the possibility that the safety device 78 is actuated due to noise or other inappreciable factors, which can lead to unstable air/fuel ratio control operation, the above predetermined period of time ta is provided which is sufficiently long for determination of the substantial occurrence of a failure in the control device for the exhaust gas recirculation valve 18.

Incidentally, although the exhaust gas recirculation control device A is arranged within ECU 6 in the illustrated embodiment, part or all of the component circuits may be arranged outside ECU 6, if necessary. Also, suitable fault display means may be added in the illustrated embodiment, if required.

What is claimed is:

1. A control system for controlling an internal combustion engine having an intake system and an exhaust system, said control system comprising: an exhaust gas recirculation passageway communicating said intake system of said engine with said exhaust system of same; an exhaust gas recirculation control valve having negative pressure-actuatable means and arranged across said exhaust gas recirculation passageway; a negative pressure passageway communicating said negative pressure-actuatable means of said exhaust gas recirculation control valve with said intake system of said engine; a solenoid valve having a solenoid and arranged to open and close said negative pressure passageway; a power transistor connected to said solenoid of said solenoid valve for energization of same; an abnormality detecting circuit arranged to compare the level of an input applied to said power transistor with the level of an output of same and generate a first signal when said two levels are out of a predetermined relationship; a timer arranged to generate a second signal when said first signal is continuously generated by said abnormality detecting circuit for a predetermined period of time; and emergency means actuatable by said second signal generated by said timer.

2. The control system as claimed in claim 1, wherein said emergency means includes means responsive to said second signal to effect an alarming action.

3. The control system as claimed in claim 1, wherein said emergency means includes means responsive to said second signal to render said power transistor inoperative.

4. The control system as claimed in claim 1, wherein said abnormality detecting circuit comprises an exclusive NOR circuit having two input terminals, one of said two input terminals being connected to the input of said power transistor and the other one to the output of same, respectively.

5. The control system as claimed in claim 4, wherein said power transistor comprises an NPN type, said power transistor having a base thereof connected to said one input terminal of said exclusive NOR circuit, a collector thereof connected to said other input terminal of same, and an emitter thereof grounded, respectively.

6. The control system as claimed in claim 5, further comprising: an engine operating condition detecting circuit adapted to generate a low level binary output when absolute pressure in said intake system of said engine is lower than a predetermined value; a comparator adapted to generate a low level binary output when the temperature of engine coolant is lower than a predetermined value; and an AND circuit arranged to be supplied with said binary outputs from said engine operating condition detecting circuit and said comparator; said power transistor having said base thereof connected to the output of said AND circuit.

7. An air/fuel ratio control system for performing feedback control of the air/fuel ratio of an air/fuel mixture being supplied to an internal combustion engine having an intake system and an exhaust system, said air/fuel ratio control system comprising: sensor means for detecting the concentration of an exhaust gas ingredient emitted from said engine; fuel quantity adjusting means for producing said mixture being supplied to said engine; an electrical circuit operatively connecting said sensor means with said fuel quantity adjusting means in a manner effecting feedback control operation to control the air/fuel ratio of said mixture to a predetermined value in response to an output signal produced by said sensor means; an exhaust gas recirculation passageway communicating said intake system of said engine with said exhaust system of same; an exhaust gas recirculation control valve having negative pressure-actuatable means and arranged across said exhaust gas recirculation passageway; a negative pressure passageway communicating said negative pressure-actuatable means of said exhaust gas recirculation control valve with said intake system of said engine; and a solenoid valve having a solenoid and arranged to open and close said negative pressure passageway; said electrical circuit including a power transistor connected to said solenoid of said solenoid valve for energization of same, an abnormality detecting circuit arranged to compare the level of an input applied to said power transistor with the level of an output of same and generate a first signal when said two levels are out of a predetermined relationship, a timer arranged to generate a second signal when said first signal is continuously generated by said abnormality detecting circuit for a predetermined period of time, and emergency means actuatable by said second signal generated by said timer.

* * * * *